US010520184B2

(12) United States Patent
Zhuang et al.

(10) Patent No.: US 10,520,184 B2
(45) **Date of Patent: *Dec. 31, 2019**

(54) AUDIO LIGHTING DEVICE

(71) Applicant: XIAMEN ECO LIGHTING CO. LTD., Xiamen (CN)

(72) Inventors: Jiaqing Zhuang, Xiamen (CN); Zhenqi Yan, Xiamen (CN); Maojin Zeng, Xiamen (CN); Runfu Zhang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/868,046

(22) Filed: Jan. 11, 2018

(65) Prior Publication Data

US 2018/0245787 A1 Aug. 30, 2018

(30) Foreign Application Priority Data

Feb. 27, 2017 (CN) ..... 2017 1 0107480
Oct. 20, 2017 (CN) ..... 2017 1 0981836

(51) Int. Cl.

| | |
|---|---|
| ***F21V 14/00*** | (2018.01) |
| ***F21V 33/00*** | (2006.01) |
| ***H04R 1/28*** | (2006.01) |
| ***F21V 29/70*** | (2015.01) |
| ***F21V 19/00*** | (2006.01) |
| *H04R 1/02* | (2006.01) |
| *H04R 1/34* | (2006.01) |
| *F21Y 115/10* | (2016.01) |
| *F21V 7/00* | (2006.01) |
| *F21V 23/04* | (2006.01) |

(Continued)

(52) U.S. Cl.

CPC ..... *F21V 33/0056* (2013.01); *F21V 19/003* (2013.01); *F21V 29/70* (2015.01); *H04R 1/2819* (2013.01); *F21S 8/02* (2013.01); *F21V 3/00* (2013.01); *F21V 7/0066* (2013.01); *F21V 13/02* (2013.01); *F21V 23/0435* (2013.01); *F21V 31/005* (2013.01); *F21Y 2115/10* (2016.08); *H04R 1/021* (2013.01); *H04R 1/028* (2013.01); *H04R 1/345* (2013.01); *H04R 2201/021* (2013.01); *H04R 2420/07* (2013.01)

(58) Field of Classification Search

CPC ..... F21V 14/00; F21V 33/0056; F21V 29/70; H04R 1/028; H04R 1/026

USPC ..... 381/334, 71, 172

See application file for complete search history.

(56) References Cited

U.S. PATENT DOCUMENTS

2016/0255437 A1* 9/2016 Wen ..... F21V 23/009 381/300

* cited by examiner

*Primary Examiner* — Paul Kim
*Assistant Examiner* — Ubachukwu A Odunukwe
(74) *Attorney, Agent, or Firm* — Chun-Ming Shih; Lanway IPR Services

(57) ABSTRACT

Disclosed herein is an audio lighting device, which includes a casing, a circuit board located within the casing, an audio guiding device located below the casing, a speaker, a bass tube, a heat dissipation device, a plurality of audio signal outlets and a light source part. The audio guiding device has a top ring sheet and a bottom audio shield located therebelow; the top ring sheet and the casing are sealed to form an audio box. The speaker is located in a central opening of the top ring sheet. The bass tube is disposed on the top ring sheet of the audio guiding device, so that the audio box has open-end conduit that facilitates the propagation and output of the low-frequency audio signal.

19 Claims, 3 Drawing Sheets

(51) Int. Cl.

| | |
|---|---|
| *F21V 31/00* | (2006.01) |
| *F21V 3/00* | (2015.01) |
| *F21S 8/02* | (2006.01) |
| *F21V 13/02* | (2006.01) |

AUDIO LIGHTING DEVICE

FIELD OF INVENTION

The present disclosure relates to an audio lighting device; more particularly, to an audio lighting device with an improved audio track design.

BACKGROUND

Lighting devices are indispensable in the household or workplace. With the improvement of people's living standard, more and more people may listen to the music at home, and accordingly, the need for installing the audio system at home also increases. Moreover, in response to the need of holding meetings, the workplace should have the loudspeaker, and hence the need for installing the audio system also exists in the workplace.

Currently, the lighting devices and the audio devices are often separate devices, and hence, they should be purchased and installed separately. Furthermore, because the devices should be installed at different places, it may jeopardize the interior design and result in an aesthetically nonappealing appearance.

Moreover, although there are some lighting devices with an audio device on the market, yet they have their own disadvantages. For example, some may sacrifice the space for the audio device in order to maintain the appearance of the lighting device, thereby resulting in the audio distortion and causing discomfort to the hearing. Otherwise, some may sacrifice the original design of the appearance of the lighting device in order to improve the performance of the audio device, thereby jeopardizing the aesthetically appealing appearance. In view of the foregoing, it is a challenging development field to provide an audio lighting device that has the advantages of both the aesthetically appealing appearance and reduced audio distortion.

SUMMARY OF INVENTION

In light of the foregoing technical problems, the present inventor proposes the following aspects to respectively address some or all of the technical problems.

According to some aspects of the present disclosure, an audio lighting device is provided, which not only retains the original appearance design of the device but also effectively reduces the audio distortion. The components of said audio lighting device are described below.

The audio lighting device comprises a casing, a circuit board located within the casing, an audio guiding device located below the casing, a speaker, a bass tube, a heat dissipation device, a plurality of audio outlets and a light source part. The audio guiding device has a top ring sheet and a bottom audio shield located therebelow; the top ring sheet and the casing are sealed to form an audio box. The speaker is located in a central opening of the top ring sheet. The bass tube is disposed on the top ring sheet of the audio guiding device, so that the audio box has open-end conduit that facilitates the propagation and output of the low-frequency audio signal. The heat dissipation device is located below the audio guiding device, the center of the heat dissipation device has a bump structure raised upward, and the bump structure and the bottom audio shield of the audio guiding device form an audio guiding channel. The plurality of audio outlets are located at the outer side of the periphery of the bump structure and below the audio guiding channel. The light source part is located within the bump structure of the heat dissipation device. In one embodiment, the bump structure has a rough upper surface and the interior of the top portion thereof is filled with a heat conductive material.

In some embodiments, the bass tube comprises a first bass tube disposed above the top ring sheet, a second bass tube disposed below the top ring sheet, and a bass tube opening disposed at the bump structure. The bass tube opening corresponds to a position below the second bass tube.

In some other embodiments, the audio lighting device further comprises an outer cover, which is located at the outside of the audio guiding device to cover the audio guiding device, wherein the outer cover has a top end opening and a bottom end opening.

In some other embodiments, the casing and the top ring sheet of the audio guiding device are fixed at the upper and lower sides of the top end opening of the outer cover, respectively.

In some other embodiments, the audio lighting device further comprises a first sealing member disposed between the casing and the top end opening of the outer cover, and a second sealing member disposed between the top ring sheet of the audio guiding device and the top end opening of the outer cover.

In some other embodiments, the heat dissipation device further comprises a bottom ring sheet located outer side of the periphery of the audio outlet, wherein the bottom ring sheet is configured to fix the heat dissipation device to a position below the bottom end opening of the outer cover.

In some other embodiments, the light source part comprises a light source board fixed below the bump structure and a reflector fixed below the light source board.

In some other embodiments, the circuit board comprises an audio source control circuit configured to control the operation of the speaker, and a light source control circuit configured to control the operation of the light source board.

In some other embodiments, the circuit board further comprises a wireless module configured to form an internet of things with other device(s) or control device(s), wherein the wireless module may output an audio source control signal and a light source control signal separately, so that the audio source control circuit and light source control circuit may receive said signals respectively.

According to another aspect of the present disclosure, an audio lighting device is further provided. The components of said audio lighting device are described below.

The audio lighting device comprises a casing having a bottom end opening, a circuit board accommodated by and fixed within the casing, an outer cover having a top end opening and a bottom end opening, an audio guiding device having a top ring sheet and a bottom audio shield, a speaker located in the opening of the top ring sheet, a bass tube disposed at the top ring sheet of the audio guiding device, a heat dissipation device having a bump structure, and a light source part located within the heat dissipation device bump structure. The heat dissipation device further has plurality of audio outlets disposed outer side of the periphery below the bump structure, and the audio outlet further has a bottom ring sheet disposed outer side of the periphery thereof.

The top end opening of the outer cover and the bottom end opening of the casing are dock-sealed, the top ring sheet of the audio guiding device and the top end opening of the outer cover are sealed by abutting the two, so that the top ring sheet and the casing form an audio box. The bass tube allows the audio box to have an open-end conduit, thereby facilitating the propagation and output of the low frequency audio signal. The bottom ring sheet of the heat dissipation device and the bottom end opening of the outer cover are fixedly connected with each other, so that the bottom audio shield of the audio guiding device, the lower portion of the outer cover, and the bump structure form an audio guiding channel that allows for the propagation and output of the audio signal via the audio outlet.

In some embodiments, the bass tube comprises a first bass tube, which is disposed above the top ring sheet.

In some other embodiments, the bass tube comprises a second bass tube, which is disposed below the top ring sheet, and the opening of the second bass tube is located at the bump structure.

In some other embodiments, the audio lighting device further has a first sealing member disposed between the top end opening of the outer cover and the bottom end opening of the casing.

In some other embodiments, the audio lighting device further has a second sealing member disposed between the top ring sheet of the audio guiding device and the top end opening of the outer cover.

In some other embodiments, the audio lighting device further has a third sealing member between the bottom ring sheet of the heat dissipation device and the bottom end opening of the outer cover.

In some other embodiments, the light source part comprises a light source board fixed below the bump structure, a reflector fixed below the light source board, and a diffusion plate fixed at the inner side of the periphery of the bump structure.

In some other embodiments, the circuit board comprises an audio source control circuit configured to control the operation of the speaker, a light source control circuit configured to control the operation of the light source board, and a wireless module configured to form an internet of things with other device(s) or control device(s). The wireless module may output an audio source control signal and a light source control signal separately, so that the audio source control circuit and light source control circuit may receive said signals respectively.

According to another aspect of the present disclosure, an audio lighting device is further provided.

The audio lighting device comprises a casing, a circuit board disposed within the casing, an audio guiding device located below the casing, a speaker, a bass tube, a heat dissipation device, a plurality of audio outlets, and a light source part. The circuit board comprises a wireless module, which is configured to receive and transmit a wireless signal, so as to form an internet of things with other device(s) or control device(s) or form an audio system with multiple audio tracks with other audio lighting devices(s). The audio guiding device has top ring sheet and a bottom audio shield located therebelow, wherein the top ring sheet and the casing are sealed to form an audio box. The speaker is located in the central opening of the top ring sheet. The bass tube is disposed on the top ring sheet of the audio guiding device, so that the audio box has an open-end conduit, thereby facilitating the facilitating the propagation and output of the low-frequency audio. The heat dissipation device is located below the audio guiding device, the center of the heat dissipation device has a bump structure raised upward, and the bottom audio shield of the audio guiding device forms the audio guiding channel. The plurality of audio outlets are located at the outer side of the periphery of the bump structure and below the audio guiding channel. The light source part is located within the bump structure of the heat dissipation device.

In some embodiments, the bass tube comprises a first bass tube disposed above the top ring sheet, a second bass tube disposed below the top ring sheet, and a bass tube opening disposed at the bump structure. The bass tube opening corresponds to a position below the second bass tube.

In some other embodiments, the circuit board comprises an audio source control circuit configured to control the operation of the speaker and a light source control circuit configured to control the operation of the light source board.

By using the embodiments described above, it is possible to address one or more above-mentioned technical problems in view of the different technical features of the embodiments.

As could be appreciated, this section presents a simplified summary of the disclosure in order to provide a basic understanding to the reader. This summary is not an extensive overview of the disclosure and it does not identify key/critical elements of the present invention or delineate the scope of the present invention.

BRIEF DESCRIPTION OF DRAWINGS

The present description will be better understood from the following detailed description read in light of the accompanying drawings as set forth below.

Figure 1:
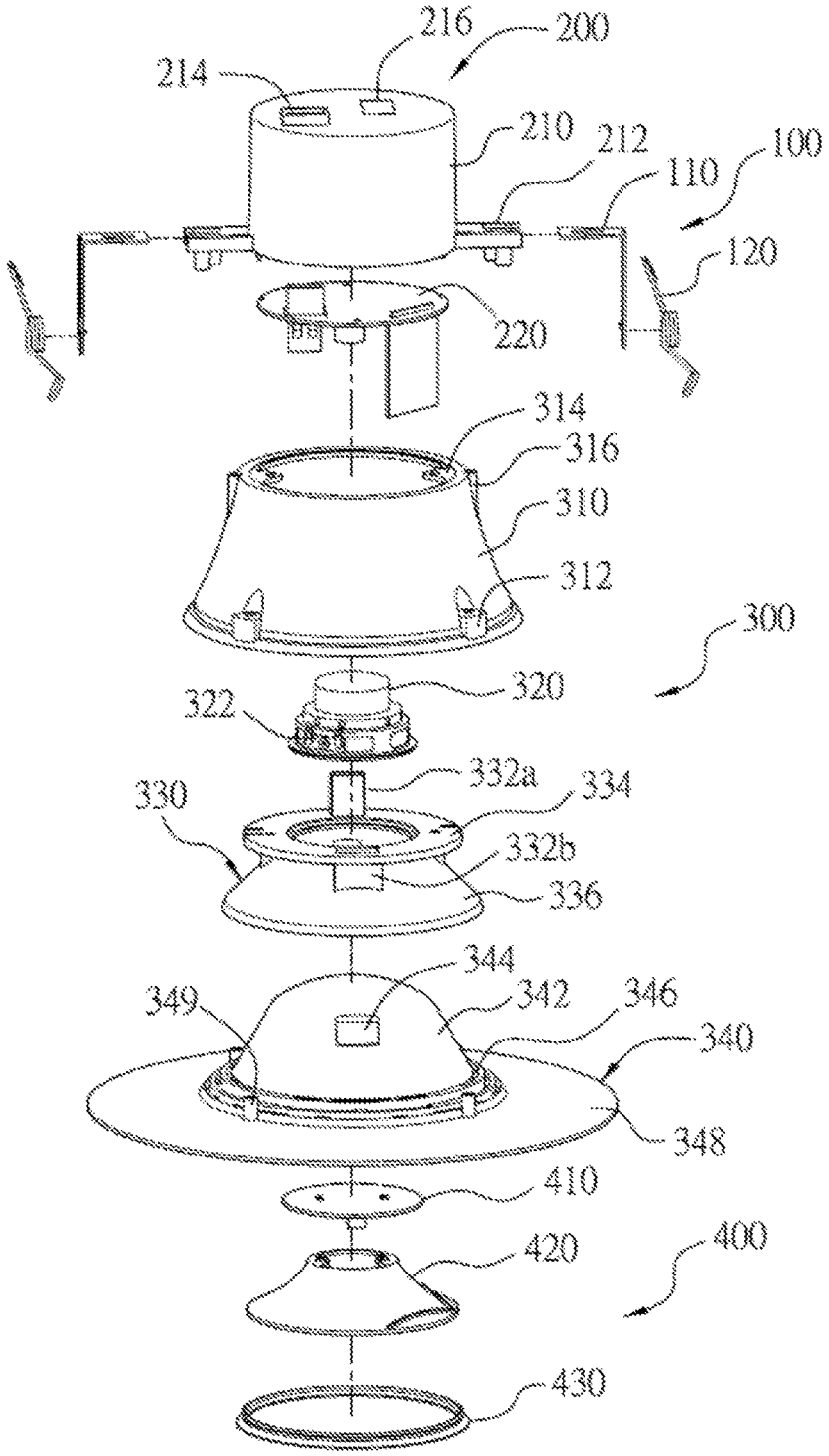
FIG. 1 is a schematic diagram illustrating the overall exploded view of an audio lighting device according to one embodiment of the present disclosure.

In accordance with common practice, the various described features/elements are not drawn to scale but instead are drawn to best illustrate specific features/elements relevant to the present invention. Also, like reference numerals and designations in the various drawings are used to indicate like elements/parts.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

According to one embodiment of the present disclosure, an audio lighting device is provided, in which the audio lighting device not only retains the original appearance design of a lighting device but also effectively reduces the audio distortion.

Referring to FIG. 1, which is a schematic diagram illustrating the overall exploded view of an audio lighting device according to one embodiment of the present disclosure. In FIG. 1, the audio lighting device comprises sequentially, from top to bottom, a fixation part 100, a control part 200, an audio part 300, and a light source part 400.

The fixation part 100 is configured to facilitate the fixation of the audio lighting device in a predetermined installation environment, and hence, the fixation part 100 may be any available fixation elements. For example, in FIG. 1, the fixation part 100 consists of a bracket 110 and a spring 120.

The control part 200 comprises, basically, a casing 210 and a circuit board 220. The bottom of the casing 210 has a bottom end opening, configured to accommodate and cover the circuit board 220, so as to protect the circuit board 220. The casing 210 may further have a first connecting member 212 and a power socket 214 disposed thereon. The first connecting member 212 is configured to be connected with the fixation part 100, thereby facilitating the installation of the audio lighting device. The power socket 214 is configured to form an electrical connection with an external power source, and also form an electrical connection with the circuit board 220, thereby supplying the electricity required for the operation of the circuit board 220.

Figure 2:
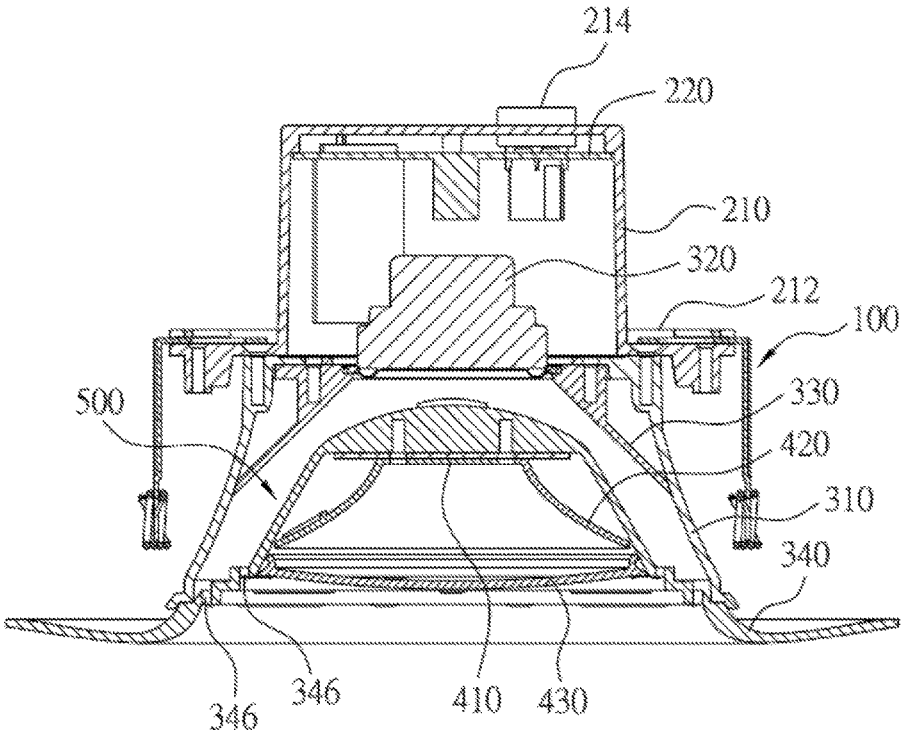
FIG. 2 is a schematic diagram illustrating the cross-sectional view of the combined structure of an audio lighting device according to one embodiment of the present disclosure.
Figure 3:
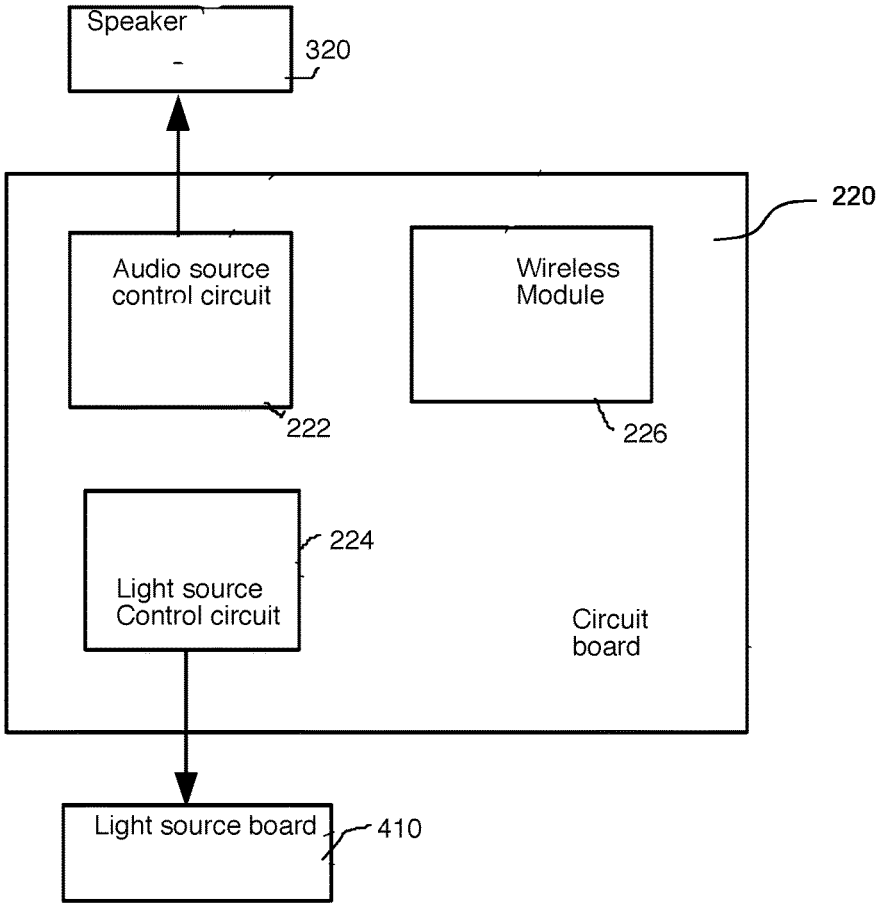
FIG. 3 is a schematic diagram illustrating the internal functional blocks of the circuit board of an audio lighting device according to one embodiment of the present disclosure.

Referring to FIG. 3 at the same time. The circuit board 220 is located in the space within the casing 210, and the printed circuit board thereof has an audio source control circuit 222 and a light source control circuit 224 fixed thereon. The audio source control circuit 222 may control the operation of the speaker 320 of the audio part 300, such as the output and volume of the audio signal; the light source control circuit 224 may control the brightness of the light emitted by the light source board 410 of the light source part 400. Since the circuit board 220 is fixed at a position below the top plate of the casing 210 (also referring to FIG. 2), the surface of the circuit board 220 that is relatively flat faces upward to facilitate the fixation of the circuit board 220.

In some embodiments, the circuit board 220 further comprises a wireless module 226 thereon. The wireless communication system of the wireless module 226 may be, for example, a blue tooth system or a wireless fidelity (Wi-Fi) system. In some embodiments, the wireless module 226 is configured to allow the interconnection of multiple audio lighting devices, thereby forming an audio system with multiple audio tracks. In some other embodiments, the wireless module 226 may further allow the interconnection of the audio lighting device with other device(s), thereby forming an internet of things. In some other embodiments, the wireless module 226 is further configured to allow the audio lighting device to receive the wireless signal from other controller(s), and to output the audio source control signal and light source control signal separately, so as to individually control the operation of the control speaker 320 and the light source board 410 after the audio source control circuit 222 and light source control circuit 224 receive said signals, respectively. The above-mentioned controller may be, for example, a common remote control, mobile phone, or other types of available controller. The audio part 300 comprises, basically, components such as an outer cover 310, a speaker 320, an audio guiding device 330, and a heat dissipation device 340. The outer cover 310 has a top end opening and a bottom end opening. The periphery of the top end opening of the outer cover 310 extends inwardly to form a second connecting member 314, and extends outwardly to form a third connecting member 316. In this way, the upper portion of the second connecting member 314 and third connecting member 316 located on the upper portion of the outer cover 310 abuts with the lower portion of the periphery of the bottom end opening and the first connecting member 212 of the casing 210, in which the two are fixated with each other (also referring to FIG. 2) using any available fixation connecting member (not shown in the drawings). For example, the fixation connecting member may be a screw/screw hole, bolt/bolt hole, etc. Moreover, in some embodiments, a first sealing member (not shown in the drawings) may be further incorporated between the outer cover 310 and the casing 210; for example, the first sealing member may be an O-shaped sealing ring or pad, so that there is no gap between the outer cover 310 and the casing 210, thereby forming a seal condition. Additionally, the periphery of the bottom of the outer cover 310 has a plurality of first fixing members 312, which are configured to fix the heat dissipation device 340 and the outer cover 310 with each other.

The speaker 320, in addition to the driver unit, further has an electrical connection terminal 322, configured to form an electrical connection with the audio source control circuit 222 of the circuit board 220.

Together, the top ring sheet 334 at the top and the bottom audio shield 336 at the bottom form the external configuration of the audio guiding device 330. The upper periphery of the top ring sheet 334 and lower portion of the outer cover 310 top end connecting member may be fixed with each other using any available fixation connecting member (not shown in the drawings). For example, the fixation connecting member may be a screw/screw hole, bolt/bolt hole, etc. Moreover, in some embodiments, a second sealing member (not shown in the drawings) may be further incorporated between the outer cover 310 and the casing 210; for example, the second sealing member may be an O-shaped sealing ring or pad, so that there is no gap between the outer cover 310 and the casing 210, thereby forming a seal condition.

The opening at the center of the top ring sheet 334 is configured to accommodate and fix the speaker 320 tightly. Referring to FIG. 2, in this way, the casing 210 and the top ring sheet 334 of the audio guiding device 330 forms the audio box of the speaker 320, and the connecting portions of the two are tightly sealed, so that when the speaker 320 outputs the audio signal, it would not output the noises arising from the mutual impact of the audio wave vibrations.

Additionally, an open-end conduit of the first bass tube 332*a* is disposed above the top ring sheet 334, while an open-end conduit of the second bass tube 332*b* is disposed below the top ring sheet 334. Compared with a sealed audio box, the first bass tube 332*a* and the second bass tube 332*b* not only allow the audio box to withstand a greater sound pressure, but also output the low-frequency audio signal reflected from the top of the casing 210 (i.e., the circuit board 220) to the exterior of the audio box, thereby enhancing the performance of the low-frequency audio signal and giving a more pleasant low-frequency audio signal. For example, the first bass tube 332*a* and second bass tube 332*b* may directly output the low-frequency audio signal to the space below the bottom audio shield 336 (i.e., the audio guiding channel 500 to be discussed below), and propagate it to the exterior via the audio outlet 346.

The center of the heat dissipation device 340 is raised upward to form a bump structure 342 with an arc upper end to facilitate the audio guiding. The lower periphery of the bump structure 342 has a plurality of audio outlets 346, the outer periphery of the audio outlet 346 is the bottom ring sheet 348. Referring to FIG. 2, the bottom ring sheet 348 of the heat dissipation device 340 has a plurality of second fixing members 349, configured to match the first fixing member 312 at the lower periphery of the outer cover 310, so as to allow the mutual fixation between the outer cover 310 and the heat dissipation device 340. For example, the first fixing member 312 and the second fixing member 349 may be a screw and a screw hole, respectively. Moreover, the connection part between the outer cover 310 and the heat dissipation device 340 may further comprise an optional third sealing member, configured to avoid the noise arising from the vibration of audio signals due to the gap between the outer cover 310 and the heat dissipation device 340. The third sealing member may be, for example, an O-shaped sealing ring or pad.

A bass tube opening 344 is disposed on the bump structure 342; the position of the bass tube opening 344 corresponds to the lower opening of the bass tube 332*b*, and the bass tube opening 344 is configured to output the low-frequency audio signal to the space below the bump structure 342. The audio outlet 346 may be made with any available shape, such as a ring shape or a circular shape, or even a honeycomb shape. Besides, a clamping member (not shown in the drawings) is disposed at the internal surface of the interior of the bottom audio outlet 346 of the bump structure 342.

Referring to FIG. 2 at the same time, there is a distance between the heat dissipation device 340 and the audio guiding device 330 because of the fixation approach. Accordingly, the bottom audio shield 336 at the lower half of the audio guiding device 330, the lower half of the outer cover 310, and the bump structure 342 of the heat dissipation device 340 forms the audio guiding channel 500 for the audio signal, in which the audio signal of the speaker is guided through the audio guiding channel 500 to the audio outlet 346 and finally outputted to the exterior of the audio lighting device. In some embodiments, the wall of the whole audio guiding channel 500 is made of a metal material with a relatively greater thickness to reduce the high-frequency noise arising from the resonance of a thinner wall with the audio signal and also to facilitate the reflection of the audio signal. In some embodiments, the thickness of the metal material may be, for example, 3 mm to 30 mm, and the metal material may be, for example, die cast aluminum or copper. In addition, to reduce the inner loss of the audio energy and to maximize the audio signal to be transmitted to the exterior through the audio guiding channel 500 and the audio outlet 346, the bottom surface of the bottom audio shield 336 of the audio guiding device 330 and the upper surface of the bump structure 342 are smooth, thereby facilitation the propagation of the audio signal.

In FIG. 1, the light source part 400 comprises sequentially, from top to bottom, a light source board 410, a reflector 420, and a diffusion plate 430. The light source board 410 is fixed below the bump structure 342 of the heat dissipation device 340 (referring to FIG. 2), wherein the light source board 410 is configured to fix one or more light sources, such as light emitting diodes (LEDs). The reflector 420 is fixed on the light source board 410, and is configured to reflect the light emitted from the light source on the light source board 410. The diffusion plate 430 is fixed on the clamping member at the inner surface of the interior of the bottom audio outlet 346 of the bump structure 342 of the heat dissipation device 340, and is configured such that in does not block the audio outlet 346. With the diffusion plate 430, the light source may emit a light that is more uniform and less dazzling.

Referring to FIG. 2, which is a schematic diagram illustrating the cross-sectional view of the combined structure of an audio lighting device according to one embodiment of the present disclosure. In FIG. 2, the fixation part 100 is fixed on the first connecting member 212 of the casing 210. A power socket 214 is disposed on the top of the casing 210. The circuit board 220, on the other hand, is fixed below the top plate of the casing 210 with the IC and circuit components thereof facing downward. Using the outer cover 310 as the fixing bracket, the casing 210 is fixed on the outer cover 310, and the audio guiding device 330 is fixed below the outer cover 310, while the speaker 320 is fixed within the central opening of the audio guiding device 330. In some embodiments, a first sealing member and a second sealing member are respectively incorporate between the casing 210 and the outer cover 310 and between the outer cover 310 and the audio guiding device 330, so that the casing 210 and the top ring sheet 334 of the audio guiding device 330 form a sealed audio box of the speaker 320. Nonetheless, open-end conduits of the first bass tube 332*a* and the second bass tube 332*b* are respectively disposed at the upper and lower portions of the top ring sheet 334 of the audio guiding device 330, to enhance the performance of the low-frequency audio signal and increase the level of tolerance to the sound pressure. In this way, it is feasible to address the problem of a completely sealed audio box, in which an amplifier with a great power is required to push the audio box to achieve a desired low-frequency audio performance.

Then, the heat dissipation device 340 is fixed at the periphery of the bottom end of the outer cover 310, so that there is a distance between the heat dissipation device 340 and the audio guiding device 330. In this way, the bottom audio shield 336 at the lower portion of the audio guiding device 330, the lower half of the outer cover 310, and the bump structure 342 of the heat dissipation device 340 form the audio guiding channel 500 for the audio signal. The audio signal from the speaker 320 may pass through said audio guiding channel 500 so that the audio signal is guided to the audio outlet 346 and outputted to the exterior.

Next, the light source board 410 is fixed below the bump structure 342 of the heat dissipation device 340, whereas the reflector 420 is fixed below the light source board 410 and is configured to reflect the light emitted from the light source of the light source board 410. Last, the diffusion plate 430 is fixed on the clamping member disposed at the inner side of the audio outlet 346 of the heat dissipation device 340, so that it does not block the audio outlet 346.

In view of the foregoing, due to the disposition of the first bass tube 332*a* and the second bass tube 332*b* on the audio guiding device 330 as well as the disposition of the bass tube opening 344 on the bump structure 342, the audio box formed by the casing 210 and the top ring sheet 334 of the audio guiding device 330 is capable of not only withstanding a greater sound pressure but also improving the performance of the low-frequency audio signal and enhancing the audio quality of the audio signal outputted by the audio lighting device without increasing the space occupied by the audio part 300. Moreover, the circuit board 220 further comprises a wireless module 226, thereby endowing the audio lighting device with more functionalities, such as the audio signal of multiple audio tracks, remote control, etc.

Accordingly, the audio lighting device that integrate the audio device and lighting device is a better choice for consumers longing for a better audio quality or incapable of enduring poor audio quality when they considering to adopt a single audio lighting device to replace the audio device and lighting device that are originally two separated devices.

Although various aspects of the invention have been described above with a certain degree of particularity, or with reference to one or more individual aspects, those with ordinary skill in the art could make numerous alterations to the disclosed aspects, such as the addition or deletion of one or more elements, without departing from the spirit or scope of this invention.

The invention claimed is:

1. An audio lighting device, comprising:

a casing;

a circuit board, located within the casing;

an audio guiding device, located below the casing, wherein the audio guiding device has a top ring sheet and a bottom audio shield located below the top ting sheet, the top ring sheet and the casing are sealed to form an audio box, and the center of the top ring sheet further has an opening;

a speaker, located in the central opening of the top ring sheet;

a bass tube, disposed above the top ring sheet of the audio guiding device, so that the audio box has an open-end conduit, thereby facilitating the propagation and output of a low-frequency audio signal;

a heat dissipation device, located below the audio guiding device, wherein a center of the heat dissipation device has a bump structure raised upward, and the bump structure and the bottom audio shield of the audio guiding device form an audio guiding channel;

a plurality of audio outlets, located at the outer side of a periphery of the bump structure and below the audio guiding channel; and a light source part, located within the bump structure of the heat dissipation device.

2. The audio lighting device according to the claim 1, wherein the bass tube comprises, a first bass tube, disposed above the top ring sheet;

a second bass tube, disposed below the top ring sheet; and a bass tube opening, disposed at the bump structure and corresponding to a position below the second bass tube.

3. The audio lighting device according to the claim 1, further comprising an outer cover having a top end opening and a bottom end opening, wherein the outer cover is located at the outer side of the audio guiding device to cover the audio guiding device.

4. The audio lighting device according to the claim 3, wherein the casing and the top ring sheet of the audio guiding device are respectively fixed to the upper and lower sides of the top end opening of the outer cover.

5. The audio lighting device according to the claim 4, further comprising a first sealing member disposed between the casing and the top end opening of the outer cover; and a second sealing member disposed between the top ring sheet of the audio guiding device and the top end opening of the outer cover.

6. The audio lighting device according to the claim 1, wherein the heat dissipation device further comprises a bottom ring sheet located at the outer side of the periphery of the audio outlet, and the bottom ring sheet is configured to fix the heat dissipation device below the bottom end opening of the outer cover.

7. The audio lighting device according to the claim 1, wherein the light source part comprises:

a light source board, fixed below the bump structure, wherein the light source board has at least one light source; and a reflector, fixed below the light source board.

8. The audio lighting device according to the claim 7, wherein the circuit board comprises, an audio source control circuit, configured to control the operation of the speaker; and a light source control circuit, configured to control the operation of the light source board.

9. The audio lighting device according to the claim 8, wherein the circuit board further comprises a wireless module, configured to form an internet of things with one or more other devices or control devices, wherein the wireless module outputs an audio source control signal and a light source control signal, respectively, and the audio source control circuit and the light source control circuit receive the audio source control signal and the light source control signal, respectively.

10. An audio lighting device, comprising:

a casing, having a bottom end opening;

a circuit board, configured to be accommodated by and fixed within the casing;

an outer cover, having a top end opening and a bottom end opening, wherein the top end opening of the outer cover and the bottom end opening of the casing are sealed by butting;

an audio guiding device, having a top ring sheet and a bottom audio shield, wherein the top ring sheet of the audio guiding device and the top end opening of the outer cover are sealed by butting, so that the top ring sheet and the casing form an audio box, and the center of the top ring sheet further has an opening;

a speaker, located within the opening of the top ring sheet;

a heat dissipation device, comprising a bump structure located at a center of the heat dissipation device and raised upward, a plurality of audio outlets located at a lower outer periphery of the bump structure, and a bottom ring sheet located outside a periphery of the audio outlet, wherein the bump structure has a rough upper surface and a top end filled with a heat conductive material there within, the bottom ring sheet of the heat dissipation device and the bottom end opening of the outer cover are connected with each other fixedly, so that the bottom audio shield of the audio guiding device, a lower half of the outer cover, and the bump structure form an audio guiding channel to propagate and output the audio signal via the audio outlet; and a light source part, located within the heat dissipation device bump structure.

11. The audio lighting device according to the claim 10, further comprising a bass tube, disposed above the top ring sheet of the audio guiding device, so that the audio box has an open-end conduit to facilitate the propagation and output of a low-frequency audio signal, wherein the bass tube comprises a first bass tube disposed above the top ring sheet.

12. The audio lighting device according to the claim 11, wherein the bass tube further comprises a second bass tube disposed below the top ring sheet, wherein the opening of the second bass tube is located on the bump structure.

13. The audio lighting device according to the claim 10, further comprising a first sealing member disposed between the top end opening of the outer cover and the bottom end opening of the casing.

14. The audio lighting device according to the claim 10, further comprising a second sealing member disposed between the top ring sheet of the audio guiding device and the top end opening of the outer cover.

15. The audio lighting device according to the claim 10, further comprising a third sealing member disposed between the bottom ring sheet of the heat dissipation device and the bottom end opening of the outer cover.

16. The audio lighting device according to the claim 10, wherein the light source part comprises a light source board fixed below the bump structure.

17. The audio lighting device according to the claim 10, wherein the circuit board comprises:

an audio source control circuit, configured to control the operation of the speaker;

a light source control circuit, configured to control the operation of the light source part; and a wireless module, configured to form an internet of things with one or more other devices or control devices, wherein the wireless module outputs an audio source control signal and a light source control signal, respectively, and the audio source control circuit and the light source control circuit receive the audio source control signal and the light source control signal, respectively.

18. An audio lighting device, comprising:

a casing;

a circuit board, located within the casing, wherein the circuit board comprises a wireless module configured to form an internet of things with one or more other devices or control devices, wherein the wireless module outputs an audio source control signal and a light source control signal, respectively, and the audio source control circuit and the light source control circuit receive the audio source control signal and the light source control signal, respectively;

an audio guiding device, located below the casing, wherein the audio guiding device has a top ring sheet and a bottom audio shield located therebelow, and the top ring sheet and the casing are sealed to form an audio box;

a speaker, located within a central opening of the top ring sheet;

a bass tube, disposed above the top ring sheet of the audio guiding device so that the audio box has an open-end conduit to facilitate the propagation and output of a low-frequency audio signal;

a heat dissipation device, located below the audio guiding device, wherein a center of the heat dissipation device has a bump structure raised upward, and the bump structure and the bottom audio shield of the audio guiding device form an audio guiding channel;

a plurality of audio outlets, located at the outer side of a periphery of the bump structure and below the audio guiding channel; and a light source part, located within the bump structure of the heat dissipation device.

19. The audio lighting device according to the claim 18, wherein the bass tube comprises:

a first bass tube, disposed above the top ring sheet;

a second bass tube, disposed below the top ring sheet; and a bass tube opening, disposed on the bump structure and corresponding to a position below the second bass tube.

* * * * *